United States Patent [19]

Morcov

[11] 4,353,864

[45] Oct. 12, 1982

[54] PRESSURE REGENERATOR

[76] Inventor: Paul Morcov, No. 12 i/S, Georg-Büchner-Weg, 6050 Offenbach, Fed. Rep. of Germany

[21] Appl. No.: 229,248

[22] Filed: Jan. 28, 1981

Related U.S. Application Data

[62] Division of Ser. No. 967,551, Dec. 7, 1978, Pat. No. 4,307,684.

[30] Foreign Application Priority Data

Dec. 29, 1977 [DE] Fed. Rep. of Germany ..... 2758619

[51] Int. Cl.[3] ..... G21D 1/00

[52] U.S. Cl. ..... 376/402; 376/904; 165/104.31

[58] Field of Search ..... 376/402, 403, 904; 910; 122/32, 11; 165/104.31

[56] References Cited

U.S. PATENT DOCUMENTS 2,812,304 11/1957 Wheeler ..... 376/910

3,172,818 3/1965 Hibshman ..... 376/910

4,165,615 8/1979 Morcov ..... 122/11

*Primary Examiner*—Harvey E. Behrend

*Attorney, Agent, or Firm*—John C. Smith, Jr.

[57] ABSTRACT

A rotary steam boiler comprises a rotatable member mounted in a housing including heating means. The rotatable member comprises a shaft with a plurality of axially extending ducts arranged about the shaft and a plurality of pipes each having opposite ends connected to one of said ducts and having a spiral configuration, the pipes extending radially about the shaft. Inlet and outlet heads are positioned at opposite ends of the ducts, respectively, and are arranged to communicate with the ducts during rotation of the shaft whereby steam may be continuously directed through the ducts and pipes to heat the steam as the shaft rotates. A preheater and a superheater increase the efficiency of the rotary steam boiler. The rotary steam boiler may be adapted for use with nuclear power stations.

4 Claims, 7 Drawing Figures

THE DEVELOPMENT OF THERMODYNAMICS CHARACTERISTIC OF STEAM FOR A SECTION WITH V (VOLUME) = 1,5 $m^3$

| SECTION No. | PRESSURE | | | WEIGHT (kg) | | | | TEMPERATURE (°K) | | |
|---|---|---|---|---|---|---|---|---|---|---|
| | p=at | + | − | REST | INTR | CARR | TOTAL | °K | + | − |
| 1 | 11 | | | 1,18 | 7,5 | - | 8,68 | 463 | | |
| 2 | 30 | 19 | | | 10,5 | - | 19,18 | 524 | 61 | |
| 3 | 52 | 22 | | | 10,5 | - | 29,68 | 585 | 61 | |
| 4 | 75 | 23 | | | 10,5 | - | 40,18 | 645 | 60 | |
| 5 | 98 | 23 | | | 10,5 | - | 50,68 | 705 | 60 | |
| 6 | 117 | 19 | | | - | 7,5 | 50,68<br>43,18 | 775<br>773 | 70 | 2 |
| 7 | 100 | | 17 | | | 10,5 | 43,18 | 770 | | 3 |
| 8 | 77 | | 23 | | | 10,5 | 32,68 | 767 | | 3 |
| 9 | 54 | | 23 | | | 10,5 | 22,18 | 764 | | 3 |
| 10 | 32 | | 22 | | | 10,5 | 11,68 | 761 | | 3 |
| 11 | 10 | | 8,4 | | | | 1,18 | 600 | | 161 |
| 12 | 1,6 | | - | | | | 1,18 | 458 | | 142 |

PRESSURE REGENERATOR

This is a Division of application Ser. No. 967,551, filed Dec. 7, 1978, now U.S. Pat. No. 4,307,684.

BACKGROUND OF THE DISCLOSURE

This invention relates to a rotary steam boiler, which is an improvement with respect to the boiler disclosed in U.S. Pat. No. 4,165,615 issued Aug. 28, 1979 to Paune Morcov. The patent describes and claims apparatus for increasing the pressure and temperature of exhaust steam from the turbine in power stations.

The conventional condenser is eliminated because it requires a lot of water (60–100 times as much as steam).

This first apparatus comprises at least one pair of contrarotating drums each containing spirally coiled pipe and located within a casting so that succesive sections of each drum pass in sequence through one heated zone (2 quadrants) a neutral zone and a cooled zone. As a result of the temperature rise in the hot sector and an exchange of steam between the two drums, the pressure increases until it reaches its required value. This is the only method to increase the pressure of a gas in a "isochore" way, with the usual temperatures (700°–800° C.) that can be endured by the boiler material.

In the above mentioned patent the drum is provided with holes through which the steam passes from one section to another. Packings pressed hydraulically on the outer surface of the drum shaft are situated in the interior of the drums. Consequently they are not easily accessible. In the present application a single drum is provided in which lengths of spiral piping form a plurality of individual sections which are spaced around a central rotatable hollow shaft which is provided with ducts interconnecting the sections, and which has a receiver-head at one end and an outlet head at the other end. The new construction is more solid, simple and consequently more reliable. The third sector disclosed in the above-mentioned patent has been eliminated. It has been replaced by a low-pressure chamber which functions as an air-preheater and raises the thermic efficiency.

SUMMARY OF THE INVENTION

The pressure regenerator of the new construction comprises only one drum, containing conduit means arranged in a radial spirals (sections) through which the exhaust fluid flows in succession from the receiver-head to the outlet-head. The drum is located in a cylindrical housing which is divided into two parts: warm and neutral. During rotation of the drum, the exhaust steam is heated (190° to 500° C.) in the warm zone and consequently the pressure increases from 11 atm to 100 atm a discharge point, after 180° rotation. Here at the predetermined quantity of steam is delivered as fresh steam back to the turbine. In the second zone the "rest-pressure" will be successively delivered to the sections in the first zone, excepting the last 45° where the sections are connecting with a low-pressure chamber. The apparatus can be heated by a combustion source within the housing, or by an external source.

In a power station with nuclear energy, this apparatus can be utilized as a heat exchanger and where it is substituted for the condenser.

BRIEF DESCRIPTION OF THE DRAWINGS

The new construction of the pressure regenerator will now be described in detail with reference to the accompanying drawings wherein.

DESCRIPTION OF THE PREFERRED EMBODIMENT

Figure 1:
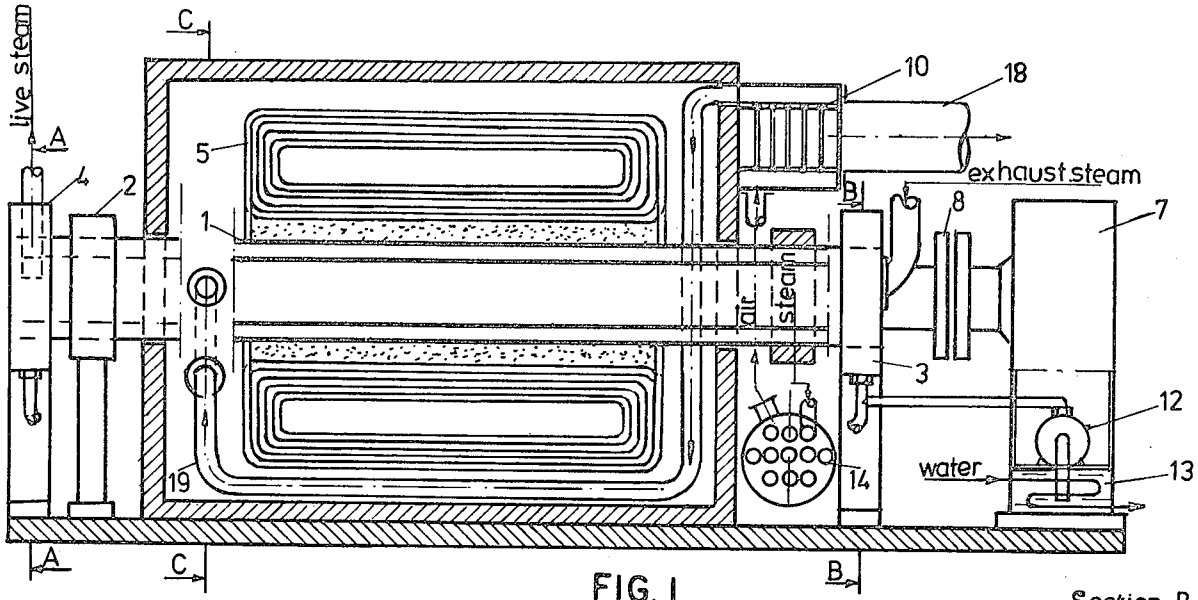
FIG. 1 is a longitudinal sectional view of the apparatus according to the invention.
Figure 2:
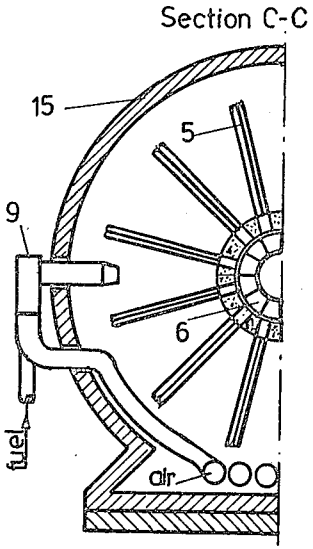
FIG. 2 is a transverse sectional view of the apparatus of FIG. 1.
Figure 4:
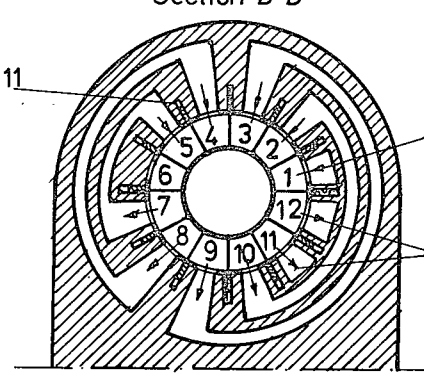
FIG. 4 is a vertical sectional view of the receiver-head.

As shown in FIGS. 1 and 2, the pressure regenerator comprises a central axle 1, which consist of 12 profiled pipes 6, which are welded together. At the one end it is provided with a coupler 8, which is connected with the gear 7, whereas the other end is equipped with an outlet-head 4. The receiver-head 3, is connected with the exhaust steam line as shown in FIG. 4. The drum-axle is mounted on two bearings 2, and the sections 5 are arranged radially. They consist of coiled pipes, the ends of which are welded with a profiled pipe of the axle 1.

The drum revolves in a closed space 15, which is equipped with a burning unit 9, with a superheater 10, and an exhaust gas line 18. The air passes through a low-pressure chamber 14, then through the air-superheater 10. From here it flows through the pipe line 19 and sector II to the burner 9.

As illustrated in FIGS. 1 and 2, the first sector (180° ) is provided with 6 sections. The first section has been charged with exhaust steam from the receiver-head, while the sixth section has been discharged by the outlet-head. The next four sections receive steam from the sections in sector II (i.e. 7,8,9,10). The last two sections of sector II are connected with the low-pressure chamber 14, i.e. sections 11 and 12.

In the low-pressure chamber the steam is cooled until it reaches its minimum pressure. Then it passes on—together with the exhaust steam from the turbine—in the section 1. And now while the drum is turning, the sections pass through sector I.

The temperature rises, new steam is let in and consequently the pressure increases until it reaches its normal value.

Figure 3:
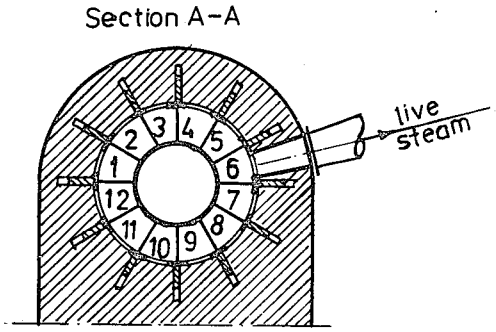
FIG. 3 is a vertical sectional view of the outlet-head.
Figure 6:
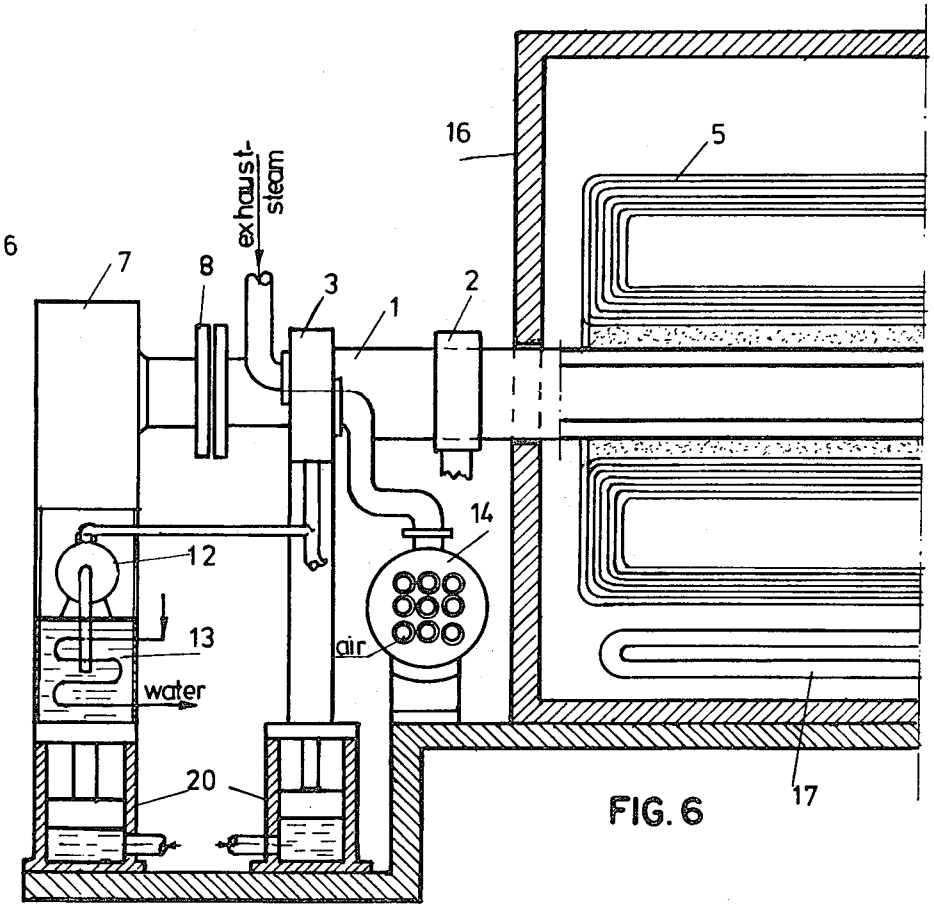
FIG. 6 is a longitudinal sectional view of the apparatus of FIG. 5.

As can be seen in FIGS. 3 and 4 the packings between the different sections are secured by plates 11, which are pressed hydraulically upon the axle. The hydraulic pressure comes from an oil-pump 12, which is situated in the gear box together with a cooler 13. In this way the problem of greasing the rubbing surface is eliminated.

Figure 5:
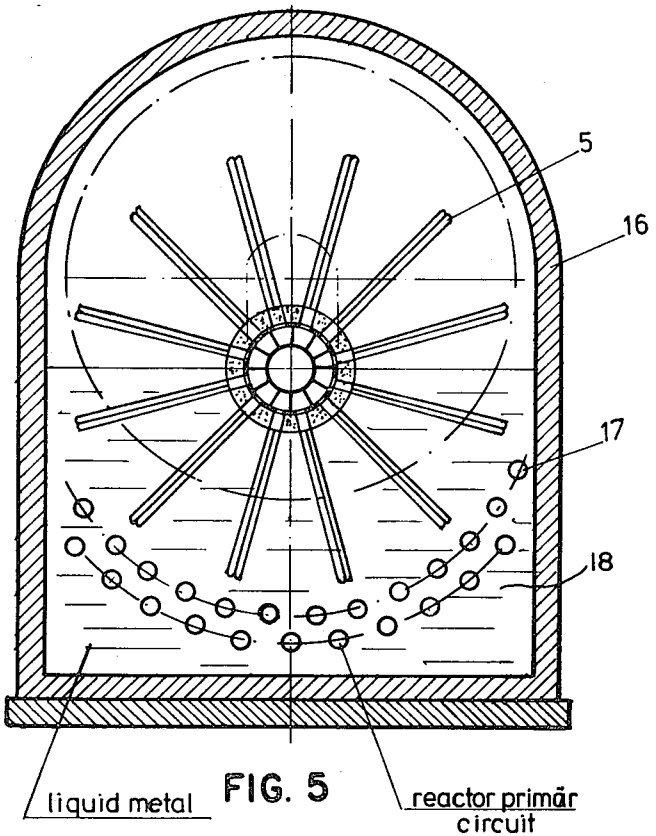
FIG. 5 is a transverse sectional view of the apparatus for use in a nuclear power station.

In nuclear power stations, this apparatus can be utilized as heat-exchanger, as illustrated in FIG. 5, where one half of the drum is immersed in a bath of liquid metal 18, which serves as a conductor of heat. This can be, for example, mercury or another soft metal alloy (lead or tin, etc.) which melts at a temperature of less than 200° C. The housing 16 is provided with pipes 17 which are passed through the bath of liquid metal and are connected to the primary circuit of the reactor. The reactor heat is taken in by the sections of the pressure regenerator and the deeper the drum is immersed in the bath, the larger becomes sector I.(hot). The space over the bath is sector II (neutral).

EXAMPLE

Figure 7:
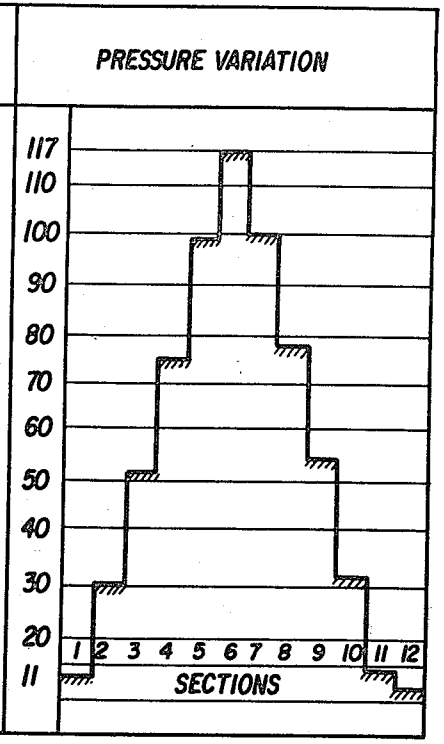
FIG. 7 shows diagrammatically the thermodynamic specifications of the steam in the example set forth in the specification.

On example of the invention is based on the following presuppositions:

The thermodynamic specifications of a pressure regenerator with a power of 50,000 kw. we find in FIG. 7. Two apparatus supply one 100,000 kw turbine. On the right part are the pressure variations, which take place in the sections.

fresh steam with p=100 atm,t=500° C. spec.-vol.=0.033 mc/kg steam quantity m=180 kg/sec exhaust steam with p=11 atm,t=190° C. spec.-vol.=0.185 mc/kg According to the Mollier diagram, the temperature drop is=575 Kj respective 137.5 kcal/kg The power: $L_{kgm}=180\times137.5\times427\times0.97=10{,}250{,}000$ kgm or $L=10{,}250{,}000/75=136{,}000$ H.P.=100,000 kW.

We have chosen two apparatus with a performance of 90 kg/sec respectively 325 t/h with 12 sections (cells) and 60 revolutions per minute, i.e. 6 cells in sector I (hot) (see FIG. 2) and 6 cells in sector II, four of which are connected with sector I and another two with the low-pressure chamber.

When choosing the volume of the section it must be taken into account that 90:12=7.5 kgs of fresh steam shall be delivered at the discharge point.

According to FIG. 7 at this moment the cell is charged with 50.68 kgs of steam (117 atm, 502° C.). After 7.5 kgs of steam have been discharged 43.18 kgs of steam will still remain in the cell. Taking into account the specific volume of this steam (v=0.03 mc/kg the volume of the cell must be:

$$V=0.03\times50.68=1.50\ m^3$$

The state equation of steam is: PV=GRT i.e.

$P=117\times1033=12{,}086{,}000\ kg/m^2$

V=cell volume=1.50 $m^3$

G=steam weight=51 kgs

R=steam constant=47

T=absolute temperature=502+273=775° K.

countertest:

$PV=12{,}086{,}000\times1.50=1{,}850{,}000=GRT=51\times47\times775$

For the coiled pipes we have chosen a pipe of 76.1×4 mm with a cross section of F=35.3 $cm^2$ The length of the coil pipe is:

$$L=1.50/0.00353=535\ m$$

The outer surface is: $F_a=0.24\times435=105\ m^2$

That means that we are dealing with a double spiral, each spiral with 5 windings of the total dimension 3.5×1.5 m. Consequently our drum has a diameter of about 3 m (FIG. 2). The heat quantity which is required per cell (section)-see FIG. 7 is calculated as follows:

| | |
|---|---|
| steam enthalpy with 503° C. and 117 atm | = 812.5 Kcal/kg |
| steam enthalpy with 190° C. and 1.6 atm | = 675.0 Kcal/kg |
| difference | = 137.5 Kcal/kg |

-continued

| |
|---|
| Total = 1.18 kg + 7.5 = 8.68 kg × 137.5 = 1.197 Kcal/cell |

The other heat quantity for 42.0 kgs of steam which fluctuates between the sections 7 and 10 in sector II and the sections 2 and 5 in sector I, is only of importance for the heat loss which is caused by conduction and radiation concerning the burning unit (see heat balance). The according calories for steam and air-heating are required to heat the coiled pipes in sector I that have precedingly been cooled in sector II by about 5° C.

HEAT TRANSMISSION

The 1197 Kcal/section are received by the steam and have to pass the wall of the pipe (by means of conduction, convection and radiation):

heat conduction through the wall of the pipe (Dubbel I.p 443)

$$Q\cdot z=(2\times3.14\times\lambda\times L/l_g\cdot nat\cdot d_a/d_i)\times(t_{w1}-t_{w2})\ \text{Kcal/h/m}$$

λ=32 Kcal/meter

L=1 m pipe length $d_a$=exterior diameter=76.1 mm $d_i$=interior diameter=68 mm $t_{w1}$=temperature of the outer surface=520° C.

$t_{w2}$=temperature of the interior surface=500° C.

z=1 hour $$Q/1\ \text{hour}=\frac{6.28\times32\times1}{l_g\cdot nat\cdot\frac{0.0761}{0.068}}\times(520\text{–}500)\ \text{Kcal/1 hour}=$$

$$\frac{203}{l_g\cdot nat\cdot1.12}\times20=1800\times20=36{,}000\ \text{Kcal/hour}$$

$$\text{per sec.: } Q=36{,}000/3{,}600=10\ \text{Kcal/sec./1m}$$

and for 435 m and 0.5 sec. it is:

$$Q=10\times435/2=2175\ \text{Kcal},$$

that means more than 1197 Kcal as mentioned above.

THE COOLING

The low-pressure chamber has been calculated in the same way as a heat exchanger (steam-air) since it functions as air-preheater. The temperature drop is:

| | |
|---|---|
| steam enthalpy with 32 atm and 488° C. | = 818 Kcal/kg |
| steam enthalpy with 1.6 atm and 190° C. | = 681 Kcal/kg |
| difference | = 137 Kcal/kg |

As demonstrated in FIG. 1 (pos 14) the air is preheated at first in the low-pressure chamber, afterwards in the smoke gas air-preheater, and finally in sector II.

THE HEAT BALANCE/SEC.

| (a) heated by smoke gas: useful heat: | loss: |
|---|---|
| heat quantity in the exhaust steam (with 11 atm and 190°) | |
| 90 kgs × 668 | = 60,120 Kcal |
| heat received from the Pressure Regen. | |
| 1197 × 12 = 14,364 Kcal | = 14,364 Kcal |
| Total | = 74,484 Kcal |
| loss in the Pressure Regen through cooling = | |

-continued (a) heated by smoke gas: useful heat: loss:

$90 \times 137 = 1233$ Kcal
other loss (10%) $= 126$ Kcal
Total loss $= 1359$ Kcal heat quantity delivered to the turbine:

$14{,}364 - 1{,}359 = 13{,}005$ Kcal $+ 60{,}120 = 73{,}125$ Kcal/sec

The degree of the efficiency of the pressure regenerator:

$$n = \frac{73{,}125 - 1{,}359}{73{,}125} = 98\%$$

Remark:
This randement is possible with exhaust-gas, the heat thereof, is lost by the chimney.

(b) with a combustible unit of its own: useful heat loss heat received in the Pressure Regener.
$1197 \times 12 = 14.364$ Kcal 13005 1359 Kcal
theoretical quantity of combustible
with 10,000 Kcal/kg = 1.6 kg
theoretical quantity of air:
$L = 1.6 \times 11\ m^3$ = about 18 $m^3$
losses caused by the chimney = 8%
$(18 \times 900 = 16.200$ Kcal$) \times 8/100 = 1296$ Kcal
losses caused by radiation and conduction 2% $= 320$ Kcal
other losses $= 21$ Kcal
Total = 2996 Kcal
recovering by air-preheater in low-pressure chamber:
$18 \times 1.293 = 23.31$ kg $\times 0.311 \times 100°$ C. $= 724$ Kcal
recovering by air-superheater (in exhaust gas):
$23.3 \times 0.315 \times 150°$ C. $= 1{,}100$ Kcal.
total recovering $= 1{,}824$ Kcal
heat supplied $= 10{,}000 \times 1.6 = 16{,}000$ Kcal
useful heat $= 16{,}000 - 1.172 = 14{,}828$ Kcal The degree of efficiency $n = \frac{14{,}828}{16{,}000} = 93\%$ It must be observed that the degree of efficiency (for boiler and condenser) amounts to a maximum of 40–42%. With conventional plants nowadays used, generally it is 32–34 % with power stations that are exclusively provided for the production of electricity.

I claim:

1. A nuclear power plant comprising a nuclear reactor and a pressure regenerator, said pressure regenerator comprising:

(a) a housing defining a chamber and including heating means to heat a first sector of said chamber, the remaining sector of said chamber being cooler;

(b) an assembly mounted for rotation about an axis in said chamber, said assembly comprising a plurality of elongated, open-ended ducts arranged in an annular configuration about said axis and extending substantially parallel to said axis and a plurality of heat exchange means arranged radially about said annular arrangement of ducts, each of said heat exchange means being connected to one of said ducts to permit steam to circulate between each of said ducts and the associated heat exchange means; and (c) an annular receiver head and an annular outlet head in sealing engagement with opposite ends of said plurality of ducts, respectively, said receiver and outlet heads being arranged to communicate with said plurality of ducts during rotation of said assembly;

(d) said heating means comprising a bath of liquid contained in said first sector of said chamber and conduit means immersed in said liquid and connected to said nuclear reactor for heating said liquid bath;

(e) whereby steam may be directed through said receiver head, said ducts, said plurality of heat exchange means and said outlet head and may be heated in said heat exchange means during passage of said heat exchange means through said heated first sector of said chamber.

2. A rotary steam boiler according to claim 1 further comprising packing means between the opposite ends of said plurality of ducts and each of said annular heads and hydraulic means for urging said annular heads into sealing contact with the ends of said ducts.

3. A rotary steam boiler according to claim 1 wherein said annular receiver head includes conduit means for transmitting steam from successive ducts while located at at least one predetermined fixed position to successive other ducts while located at at least one other predetermined fixed position during rotation of said assembly, whereby partially heated steam from selected heat exchange means may be recycled to other selected heat exchange means for further heating in said heated first sector during rotation of said assembly.

4. A rotary steam boiler according to claim 1 wherein each of said heat exchange means comprises a pipe formed in a spiral configuration with the opposite ends thereof connected to one of said ducts.

* * * * *